US005149042A

United States Patent [19]

Dumais

[11] Patent Number: 5,149,042

[45] Date of Patent: Sep. 22, 1992

[54] CEILING FAN MOUNTING APPARATUS

[76] Inventor: Christopher E. Dumais, 8729 Graves Ave., #14C, Santee, Calif. 91971

[21] Appl. No.: 728,703

[22] Filed: Jul. 11, 1991

[51] Int. Cl.[5] ..... A47G 29/00

[52] U.S. Cl. ..... 248/317; 248/220.1; 248/340; 362/432

[58] Field of Search ..... 248/317, 339, 340, 342, 248/343, 344, 220.1, 906, 218.4, 318; 362/431, 432

[56] References Cited

U.S. PATENT DOCUMENTS

| | | | |
|---|---|---|---|
| 1,494,208 | 5/1924 | Bailey | 362/432 X |
| 2,280,402 | 4/1942 | Greppin | 362/432 X |
| 2,699,311 | 1/1955 | Monson | 248/342 |
| 2,950,892 | 8/1960 | Rick | 362/432 |
| 3,856,251 | 12/1974 | Miller | 362/432 |
| 4,049,959 | 9/1977 | Ledterman | 362/431 X |
| 4,459,650 | 7/1984 | Pike | 362/432 X |
| 4,645,158 | 2/1987 | Manning | 248/345 |
| 4,713,734 | 12/1987 | DeKay | 362/432 |

FOREIGN PATENT DOCUMENTS

| | | | |
|---|---|---|---|
| 752232 | 2/1967 | Canada | 362/432 |

*Primary Examiner*—David L. Talbott
*Attorney, Agent, or Firm*—Christopher E. Dumais

[57] ABSTRACT

The apparatus described herein is for cantileverly mounting a ceiling fan and/or a ceiling light fixture and power cord to a side wall of a building so that it appears to hang from the ceiling without the user having to actually attach it to the ceiling. The mounting apparatus is made in four sections. There is a first tubular section that has mounting holes to receive mounting fasteners to mount the first section to the side wall of a room. There is a power cord guide cap in one end of the first tubular section. A second tubular section is angularly attached at a first end to another end of the first tubular section. A third tubular section is angularly attached at a first end to a second end of the second tubular section. There is a fourth tubular section that has one end releasingly and angularly connected to a second end of the third tubular section. The third tubular section has a suspension bar attached within the second end. There is a suspension member which is removably suspended from the suspension bar. There is an attachment port in one end of the suspension member. A bolt is removably placed through the attachment port and through a fixture port, in the ceiling fan and ceiling light fixture, to releasingly attach the fixture to the suspension member. There is a hook on the other end of the suspension member to releasingly suspend the suspension member from the suspension bar.

5 Claims, 1 Drawing Sheet 16
10
19
19
24
24
23
22
20
21

16
10
17
18
11
6
6
15
19
24

26
23
22
24
19
25

22
19
10
100
102
16
102
15
14
12
13
11
13
11
15
101

26
30
31
28
27
29
103
100

CEILING FAN MOUNTING APPARATUS

BACKGROUND OF THE INVENTION

1. Field of the Invention

This invention relates to a cantilever mounted support arm which provides a means to place a ceiling fan and/or a ceiling light at the ceiling of a room whose ceiling cannot be utilized to hang and wire the fan and/or light.

2. Description of the Related Art

U.S. Pat. No. 2,699,311 to A. O. Monson on Jan. 11, 1955 shows a hanger for electric fixtures such as junction boxes and outlets. It shows a threaded hanger on two parallel arms.

U.S. Pat. No. 2,950,892 to C. Rick on Aug. 30, 1960 describes a portable lamp having a base and a tubular pivoting arm.

U.S. Pat. No. 3,856,251 to J. Miller on Dec. 24, 1974 shows a self-compensating extensible beam having a base plate that mounts to a wall and extendible, pivoting arms.

U.S. Pat. No. 4,645,158 to J. H. Manning on Feb. 24, 1987 describes a ceiling fan mounting apparatus that has a mounting plate with a support bar. The support bar is placed over the ceiling joists and is attached to the mounting plate to support a fan. There is a threaded hook from which to hang the fan.

U.S. Pat. No. 4,713,734 to T. J. DeKay on Dec. 15, 1987 shows a wall lamp assembly that has a hollow conduit to contain wires and supports a light fixture at one end. There are additional outlets along the length of the conduit.

SUMMARY OF THE INVENTION

Ceiling fans, ceiling lights and ceiling fan/light combinations are decorative and provide a certain amount of comfort to the user. However, there are situations where the fan or light cannot be installed in the ceiling in the normal manner. The owners of rental homes and apartments often will not allow the ceilings of their property to be cut into and possibly damaged to install the fan or light and the necessary wiring. The ceiling, of most apartments on a lower level, is the floor of the apartment just above it. The ceiling/floor is a solid piece of concrete which does not lend itself to the installation of a fan or light easily.

The present invention is usually mounted at a corner of a room at the point where two wall support frame timbers meet. The mounting bolts are in a criss-cross configuration which provides a very stable mount when the mounting apparatus is attached to the timbers. The third tubular section, near the ceiling, does not touch the ceiling and therefore does not transmit the fan vibrations to the ceiling. Yet the present novel mounting apparatus, in its cantilever mount and design, provides the strength to support the fan and/or lamp in a desirable location on the ceiling without having to remodel the ceiling in any manner. The angles involved in the design of the mounting support have been carefully selected and tested to provide the necessary strength and position.

An apparatus for cantileverly mounting a ceiling fan and/or a ceiling light fixture and power cord to a side wall of a building has a first tubular section that has a plurality of mounting holes to receive mounting fasteners to mount the first section to the side wall. There is a power cord guide cap in one end of the first tubular section. A second tubular section is angularly attached at a first end to another end of the first tubular section. A third tubular section is angularly attached at a first end to a second end of the second tubular section. There is a fourth tubular section that has one end releasingly and angularly connected to a second end of the third tubular section. The third tubular section has a suspension bar attached within the second end.

There is a suspension member. There is an attachment port in one end of the suspension member. A bolt is removably placed through the attachment port and through a fixture port, in the ceiling fan and ceiling light fixture, to releasingly attach the fixture to the suspension member. There is a hook on another end of the suspension member to releasingly suspend the suspension member from the suspension bar.

The angle at which the first end of the second section is attached to the other end of the first section may be selected from a range of angles from 141 to 145 degrees. The angle at which the first end of third section is attached to the second end of the second section may be selected from a range of angles from 127 to 131 degrees. The angle at which the one end of fourth section is attached to the second end of the third section may be selected from a range of angles from 87 to 91 degrees.

It is an object of this invention to provide a means to mount a ceiling fan and/or light from a position near the ceiling at a position away from the walls or at or near a center position, if desired, without having to place a hole in the ceiling to hang the fan or light and to install the wiring.

DESCRIPTION OF THE PREFERRED EMBODIMENT

Figures 1, 2, 3, 4, 5, 6, 7:
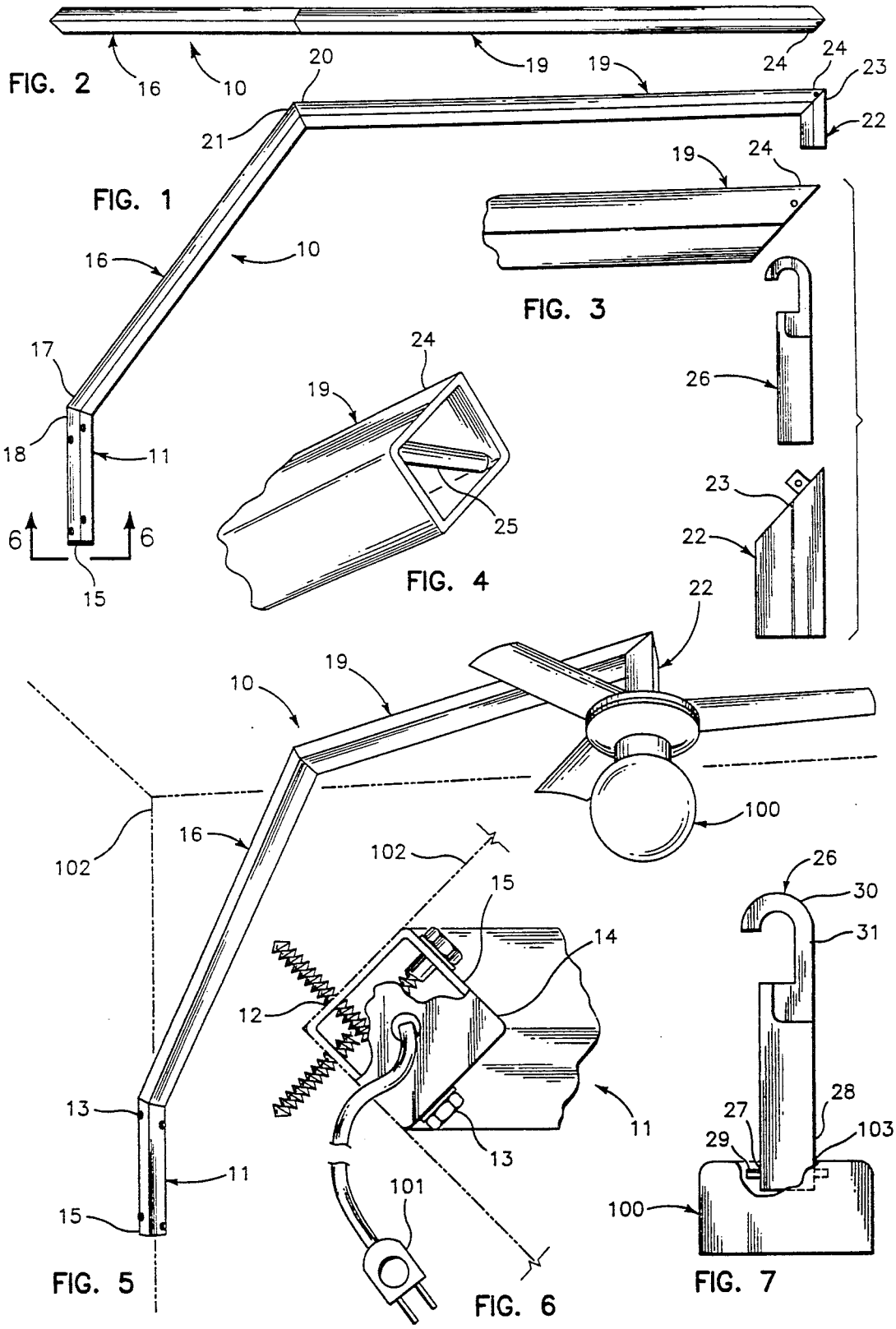
FIG. 1 is a side view of the Ceiling Fan Mounting Apparatus.
FIG. 2 is a top view of the Ceiling Fan Mounting Apparatus.
FIG. 3 is a partial exploded side view of the third tubular section, the suspension member and the fourth tubular section.
FIG. 4 is a partial perspective enlarged view of the other end of the third tubular section showing the suspension bar.
FIG. 5 is a perspective view of the Ceiling Fan Mounting Apparatus shown mounted in the corner of a room shown in phantom.
FIG. 6 is a partial view of one end of the first tubular section showing the configuration of the mounting holes, fasteners, the power cord guide cap and power cord.
FIG. 7 is a front view of the suspension member mounted in a top portion of a ceiling fan/light.

An apparatus 10 for cantileverly mounting a ceiling fan and/or a ceiling light fixture 100 and wiring 101 to a side wall 102 of a building is described that has a first tubular section 11 having a plurality of mounting holes 12 to receive mounting fasteners 13 to mount the first section 11 to the side wall 102. There is a power cord guide cap 14 in one end 15 of the first tubular section 11. A second tubular section 16 is angularly attached at an angle "A" (preferably one hundred and forty-three degrees) at a first end 17 (of the second section 16) to the other end 18 of the first tubular section 11. There is a third tubular section 19 angularly attached at an angle "B" (preferably one hundred and twenty-nine degrees) at a first end 20 (of the third section 19) to a second end 21 of the second tubular section 16. A fourth tubular section 22 has one end 23 (of the fourth section 22) releasingly and angularly connected at an angle "C" (preferably eighty-nine degrees) to a second end 24 of the third tubular section 19.

The third tubular section 19 has a suspension bar 25 attached within the second end 24 (shown in FIG. 4). There is a suspension member 26 shown in FIGS. 3 and 7. There is an attachment port 27 in one end 28 of the suspension member 26. A bolt or pin 29 is removably placed through the attachment port 27 and through a fixture port 103 in the ceiling fan and ceiling light fixture 100 to releasingly attach the fixture 100 to the suspension member 26. There is a hook 30 on the other end 31 of the suspension member 26 to releasingly suspend the suspension member 26 from the suspension bar 25.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. An apparatus for cantileverly mounting a ceiling fan, a ceiling light fixture and power cord to a side wall of a building comprising:

a. a first tubular section having a plurality of mounting holes to receive mounting fasteners to mount the first section to the side wall;

b. a power cord guide cap in one end of the first tubular section;

c. a second tubular section angularly attached at a first end to another end of the first tubular section;

d. a third tubular section angularly attached at a first end to a second end of the second tubular section;

e. a fourth tubular section having one end releasingly and angularly connected to a second end of the third tubular section;

f. the third tubular section having a suspension bar attached within the second end;

g. a suspension member;

h. an attachment port in one end of the suspension member;

i. a bolt removably placed through the attachment port and through a fixture port in the ceiling fan and ceiling light fixture to releasingly attach the fixture to the suspension member; and j. a hook on another end of the suspension member to releasingly suspend the suspension member from the suspension bar.

2. An apparatus as described in claim 1 wherein the angle at which the first end of the second section is attached to the other end of the first section is selected from a range of angles from 141 to 145 degrees.

3. An apparatus as described in claim 1 wherein the angle at which the first end of third section is attached to the second end of the second section is selected from a range of angles from 127 to 131 degrees.

4. An apparatus as described in claim 1 wherein the angle at which the one end of fourth section is attached to the second end of the third section is selected from a range of angles from 87 to 91 degrees.

5. An apparatus for cantileverly mounting a ceiling fan, a ceiling light fixture and wiring to a side wall of a building comprising:

a. a first tubular section having a plurality of mounting holes to receive mounting fasteners to mount the first section to the side wall;

b. a power cord guide cap in one end of the first tubular section;

c. a second tubular section angularly attached at an angle of one hundred and forty-three degrees at a first end to the other end of the first tubular section;

d. a third tubular section angularly attached at an angle of one hundred and twenty-nine degrees at a first end to a second end of the second tubular section;

e. a fourth tubular section having one end releasingly and angularly connected at an angle of eighty-nine degrees to a second end of the third tubular section;

f. the third tubular section having a suspension bar attached within the second end thereof;

g. a suspension member;

h. an attachment port in one end of the suspension member;

i. a bolt removably placed through the attachment port and through a fixture port in the ceiling fan and ceiling light fixture to releasingly attach the fixture to the suspension member; and j. a hook on another end of the suspension member to releasingly suspend the suspension member from the suspension bar.

* * * * *